US010508850B2

(12) United States Patent
Prins et al.

(10) Patent No.: US 10,508,850 B2
(45) Date of Patent: Dec. 17, 2019

(54) METHOD FOR CONTROLLING A VAPOUR COMPRESSION SYSTEM IN A FLOODED STATE

(71) Applicant: Danfoss A/S, Nordborg (DK)

(72) Inventors: Jan Prins, Nordborg (DK); Frede Schmidt, Sonderborg (DK); Kenneth Bank Madsen, Ry (DK); Kristian Fredslund, Haderslev (DK)

(73) Assignee: Danfoss A/S, Nordborg (DK)

( * ) Notice: Subject to any disclaimer, the term of this patent is extended or adjusted under 35 U.S.C. 154(b) by 0 days.

(21) Appl. No.: 15/763,988

(22) PCT Filed: Oct. 14, 2016

(86) PCT No.: PCT/EP2016/074774
§ 371 (c)(1),
(2) Date: Mar. 28, 2018

(87) PCT Pub. No.: WO2017/067863
PCT Pub. Date: Apr. 27, 2017

(65) Prior Publication Data

US 2018/0320944 A1 Nov. 8, 2018

(30) Foreign Application Priority Data

Oct. 20, 2015 (DK) ..... 2015 00646

(51) Int. Cl.
*F25B 49/02* (2006.01)
*F25B 5/02* (2006.01)
(Continued)

(52) U.S. Cl.
CPC ..... *F25B 49/022* (2013.01); *F25B 5/02* (2013.01); *F25B 6/02* (2013.01); *F25B 9/08* (2013.01);
(Continued)

(58) Field of Classification Search
CPC ..... F25B 2341/0012; F25B 2341/0013; F25B 43/006; F25B 2400/16; F25B 2400/23;
(Continued)

(56) References Cited

U.S. PATENT DOCUMENTS 4,067,203 A * 1/1978 Behr ..... F25B 41/062 62/208
4,301,662 A 11/1981 Whitnah
(Continued)

FOREIGN PATENT DOCUMENTS

CN 1892150 A 1/2007
CN 101329115 A 12/2008
(Continued)

OTHER PUBLICATIONS

International Search Report for Application No. PCT/EP2016/074774 dated Jan. 9, 2017.

*Primary Examiner* — Ana M Vazquez
(74) *Attorney, Agent, or Firm* — McCormick, Paulding & Huber PLLC

(57) ABSTRACT

A vapour compression system (1) includes an ejector (6) and a liquid separating device (10) arranged in a suction line. At least one evaporator (9) is allowed to be operated in a flooded state. A flow rate of refrigerant from the liquid separating device (10) to the secondary inlet (15) of the ejector (6) is detected, and it is determined whether or not the flow rate is sufficient to remove liquid refrigerant produced by the evaporator(s) (9) from the liquid separating device (10). In the case that it is determined that the flow rate of refrigerant from the liquid separating device (10) to the secondary inlet (15) of the ejector (6) is insufficient to remove liquid refrigerant produced by the evaporator(s) (9), the flow rate of refrigerant from the liquid separating device (10) to the secondary inlet (15) of the ejector (6) is increased,
(Continued)

and/or a flow rate of liquid refrigerant from the evaporator(s) (9) to the liquid separating device (10) is decreased.

20 Claims, 4 Drawing Sheets

(51) Int. Cl.
*F25B 6/02* (2006.01)
*F25B 9/08* (2006.01)

(52) U.S. Cl.
CPC . *F25B 2341/0012* (2013.01); *F25B 2400/075* (2013.01); *F25B 2400/16* (2013.01); *F25B 2400/23* (2013.01); *F25B 2500/28* (2013.01)

(58) Field of Classification Search
CPC ..... F25B 2500/28; F25B 49/022; F25B 9/08; F25B 6/02; F25B 2400/075
See application file for complete search history.

(56) References Cited

U.S. PATENT DOCUMENTS 4,522,037 A 6/1985 Ares et al.
4,573,327 A * 3/1986 Cochran ..... F25B 43/006 62/238.6
5,226,320 A * 7/1993 Dages ..... G01F 23/2962 181/124
6,698,221 B1 3/2004 You
6,786,056 B2 * 9/2004 Bash ..... F25B 5/02 62/199
7,178,359 B2 2/2007 Oshitani et al.
7,389,648 B2 6/2008 Concha et al.
9,217,590 B2 * 12/2015 Cogswell ..... F25B 1/10
9,752,801 B2 * 9/2017 Verma ..... F25B 1/10
2001/0025499 A1 10/2001 Takeuchi et al.
2003/0145613 A1 8/2003 Sakai et al.
2003/0209032 A1 11/2003 Ohta
2004/0003615 A1 1/2004 Yamaguchi
2004/0007014 A1 1/2004 Takeuchi et al.
2004/0040340 A1 3/2004 Takeuchi et al.
2004/0069011 A1 4/2004 Nishida et al.
2004/0079102 A1 4/2004 Umebayashi et al.
2004/0103685 A1 6/2004 Yamaguchi et al.
2004/0211199 A1 10/2004 Ozaki et al.
2004/0255602 A1 12/2004 Sato et al.
2004/0255612 A1 12/2004 Nishijima et al.
2004/0255613 A1 12/2004 Choi et al.
2004/0261448 A1 12/2004 Nishijima et al.
2006/0236708 A1 10/2006 Mizuno et al.
2006/0254308 A1 11/2006 Yokoyama et al.
2011/0005268 A1 1/2011 Oshitani et al.
2011/0197606 A1 8/2011 Zimmermann et al.
2012/0060523 A1 * 3/2012 Hung ..... F25B 5/00 62/93
2012/0151948 A1 6/2012 Ogata et al.
2012/0167601 A1 7/2012 Cogswell et al.
2012/0180510 A1 7/2012 Okazaki et al.
2012/0247146 A1 10/2012 Yamada et al.
2012/0324911 A1 12/2012 Shedd
2013/0042640 A1 2/2013 Higashiiue et al.
2013/0111944 A1 5/2013 Wang et al.
2013/0251505 A1 9/2013 Wang et al.
2014/0208785 A1 7/2014 Wallace et al.
2016/0109160 A1 4/2016 Junge et al.
2016/0169565 A1 6/2016 Yokoyama et al.
2016/0169566 A1 6/2016 Nakashima et al.
2018/0023850 A1 1/2018 Chaudhry et al.
2018/0066872 A1 3/2018 Hellmann
2018/0119997 A1 5/2018 Siegert et al.
2018/0142927 A1 5/2018 Hellmann et al.

FOREIGN PATENT DOCUMENTS

CN 102128508 A 7/2011
CN 201992750 U 9/2011
CN 104359246 A 2/2015
CN 104697234 A 6/2015
DE 10321191 A1 11/2003
EP 2068094 A1 6/2009
EP 2068094 A1 10/2009
JP 2001221517 A 8/2001
WO 2012/012488 A1 1/2012
WO 2012/168544 A1 12/2012
WO WO-2012168544 A1 * 12/2012 ..... F25B 9/008

* cited by examiner

METHOD FOR CONTROLLING A VAPOUR COMPRESSION SYSTEM IN A FLOODED STATE

CROSS-REFERENCE TO RELATED APPLICATIONS

This application is a National Stage application of International Patent Application No. PCT/EP2016/074774, filed on Oct. 14, 2016, which claims priority to Danish Patent Application No. PA 2015 00646, filed on Oct. 20, 2015, each of which is hereby incorporated by reference in its entirety.

FIELD OF THE INVENTION

The present invention relates to a method for controlling a vapour compression system comprising at least one evaporator which is operated in a flooded state. The method of the invention ensures that the vapour compression system is operated in an energy efficient manner, without risking that liquid refrigerant reaches the compressor.

BACKGROUND

In a vapour compression system, such as a refrigeration system, an air conditions system, a heat pump etc., a fluid medium, such as refrigerant, is alternatingly compressed by means of one or more compressors and expanded by means of one or more expansion devices, and heat exchange between the fluid medium and the ambient takes place in one or more heat rejecting heat exchangers, e.g. in the form of condensers or gas coolers, and in one or more heat absorbing heat exchangers, e.g. in the form of evaporators.

When refrigerant passes through an evaporator arranged in a vapour compression system, the refrigerant is at least partly evaporated while heat exchange takes place with the ambient or with a secondary fluid flow across the evaporator, in such a manner that heat is absorbed by the refrigerant passing through the evaporator. The heat transfer between the refrigerant and the ambient or the secondary fluid flow is most efficient along a part of the evaporator which contains liquid refrigerant. Accordingly, it is desirable to operate the vapour compression system in such a manner that liquid refrigerant is present in as large a part of the evaporator as possible, preferably along the entire evaporator.

However, if liquid refrigerant reaches the compressor unit, there is a risk that the compressor(s) of the compressor unit is/are damaged. In order to avoid this, it is necessary to either operate the vapour compression system in such a manner that liquid refrigerant is not allowed to pass through the evaporator, or to ensure that any liquid refrigerant which passes through the evaporator is removed from the suction line, and is thereby prevented from reaching the compressor unit.

WO 2012/168544 A1 discloses a multi-evaporator refrigeration circuit comprising at least a compressor, a condenser or gas cooler, a first throttling valve, a liquid/vapour separator, a pressure limiting valve, a liquid level sensing device, at least one evaporator and a suction receiver. In the refrigeration circuit at least one ejector comprising a suction port is included in parallel to the first throttling valve. The refrigeration system is adapted to drive cold liquid from the suction receiver to the suction port of the ejector. A first control valve in the line from the suction receiver to the suction port of the ejector can be opened, based on a maximum level signal generated by the liquid level sensing device, whenever the level of liquid refrigerant in the suction receiver is above a set maximum level.

SUMMARY

It is an object of embodiments of the invention to provide a method for controlling a vapour compression system in an energy efficient manner, without risking that liquid refrigerant reaches the compressor unit.

The invention provides a method for controlling a vapour compression system, the vapour compression system comprising a compressor unit, a heat rejecting heat exchanger, an ejector, a receiver, at least one expansion device and at least one evaporator arranged in a refrigerant path, the vapour compression system further comprising a liquid separating device arranged in a suction line of the of vapour compression system, the liquid separating device comprising a gaseous outlet connected to the inlet of the compressor unit and a liquid outlet connected to a secondary inlet of the ejector, the method comprising the steps of:

- allowing at least one evaporator to be operated in a flooded state,
- detecting a flow rate of refrigerant from the liquid separating device to the secondary inlet of the ejector, and determining whether or not the flow rate is sufficient to remove liquid refrigerant produced by the evaporator(s) being allowed to be operated in a flooded state from the liquid separating device, and
- in the case that it is determined that the flow rate of refrigerant from the liquid separating device to the secondary inlet of the ejector is insufficient to remove liquid refrigerant produced by the evaporator(s) being allowed to be operated in a flooded state from the liquid separating device, increasing the flow rate of refrigerant from the liquid separating device to the secondary inlet of the ejector, and/or decreasing a flow rate of liquid refrigerant from the evaporator(s) to the liquid separating device.

The method according to the invention is for controlling a vapour compression system. In the present context the term 'vapour compression system' should be interpreted to mean any system in which a flow of fluid medium, such as refrigerant, circulates and is alternatingly compressed and expanded, thereby providing either refrigeration or heating of a volume. Thus, the vapour compression system may be a refrigeration system, an air condition system, a heat pump, etc.

The vapour compression system comprises a compressor unit comprising one or more compressors, a heat rejecting heat exchanger, an ejector, a receiver, at least one expansion device and at least one evaporator arranged in a refrigerant path. Each expansion device is arranged to supply refrigerant to an evaporator. The heat rejecting heat exchanger could, e.g., be in the form of a condenser, in which refrigerant is at least partly condensed, or in the form of a gas cooler, in which refrigerant is cooled, but remains in a gaseous or trans-critical state. The expansion device(s) could, e.g., be in the form of expansion valve(s).

The vapour compression system further comprises a liquid separating device arranged in a suction line of the vapour compression system, i.e. in a part of the refrigerant path which interconnects the outlet(s) of the evaporator(s) and the inlet of the compressor unit. The liquid separating device comprises a gaseous outlet connected to the inlet of the compressor unit and a liquid outlet connected to a secondary inlet of the ejector. Thus, the liquid separating device receives refrigerant from the outlet(s) of the evaporator(s)

and separates the received refrigerant into a liquid part and a gaseous part. The liquid part of the refrigerant is supplied to the secondary inlet of the ejector, and at least part of the gaseous part of the refrigerant may be supplied to the inlet of the compressor unit. It is not ruled out that some or all of the gaseous part of the refrigerant may be supplied to the secondary inlet of the ejector, along with the liquid part of the refrigerant. However, the liquid part of the refrigerant is not supplied to the inlet of the compressor unit. Accordingly, the liquid separating device ensures that any liquid refrigerant which leaves the evaporator(s) and enters the suction line is prevented from reaching the compressor unit.

According to the method of the invention, at least one evaporator is allowed to be operated in a flooded state. Accordingly, liquid refrigerant is allowed to pass through at least one of the evaporators and enter the suction line. As described above, this liquid refrigerant is separated from the gaseous refrigerant in the liquid separating device, in order to prevent it from reaching the compressor unit.

Next, a flow rate of refrigerant from the liquid separating device to the secondary inlet of the ejector is detected, and it is determined whether or not the flow rate is sufficient to remove liquid refrigerant produced by the evaporator(s) being allowed to be operated in a flooded state from the liquid separating device. Thus, a more or less continuous refrigerant flow from the liquid separating device towards the secondary inlet of the ejector may be present, i.e. the ejector may be operating more or less continuously. However, the flow rate of this refrigerant flow may be varying.

If the amount of liquid refrigerant entering the suction line, and thereby the liquid separating device, from the evaporator(s) being allowed to be operated in a flooded state exceeds the amount of refrigerant flowing from the liquid separating device towards the secondary inlet of the ejector, then liquid refrigerant will accumulate in the liquid separating device. This is acceptable for a limited period of time, but if the situation continues, the liquid separating device will eventually be filled with liquid refrigerant, and it is no longer possible to prevent liquid refrigerant from reaching the compressor unit. This is undesirable, since it may cause damage to the compressor(s) of the compressor unit.

Accordingly, in the case that the flow rate of refrigerant from the liquid separating device to the secondary inlet of the ejector is insufficient to remove the liquid refrigerant produced by the evaporator(s) being allowed to be operated in a flooded state from the liquid separating device, there is a risk that the situation described above occurs, and measures must be taken in order to avoid this. Thus, when this is detected, the flow rate of refrigerant from the liquid separating device to the secondary inlet of the ejector is increased, and/or a flow rate of liquid refrigerant from the evaporator(s) to the liquid separating device is decreased. In the former case, the amount of refrigerant flowing from the liquid separating device towards the secondary inlet of the ejector is increased, thereby allowing the liquid refrigerant supplied by the evaporator(s) to be removed from the liquid separating device. In the latter case, the amount of liquid refrigerant supplied to the liquid separating device by the evaporator(s) is reduced, thereby allowing the liquid refrigerant to be removed from the liquid separating device towards the secondary inlet of the ejector at the current flow rate. In any event, accumulation of liquid refrigerant in the liquid separating device is prevented.

Thus, when a vapour compression system is controlled in accordance with the method according to the invention, at least some of the evaporators are allowed to operate in a flooded state, thereby improving the heat transfer of the evaporator(s), while it is efficiently prevented that liquid refrigerant reaches the compressor(s) of the compressor unit.

The step of increasing the flow rate of refrigerant from the liquid separating device to the secondary inlet of the ejector may comprise reducing a pressure prevailing inside the receiver. When the pressure prevailing inside the receiver is reduced, the pressure difference across the ejector, i.e. the pressure difference between the refrigerant leaving the heat rejecting heat exchanger and entering the primary inlet of the ejector and the refrigerant leaving the ejector and entering the receiver, is increased. This increases the capability of the ejector to drive the secondary refrigerant flow in the ejector, i.e. the flow of refrigerant entering the ejector via the secondary inlet. Thereby the flow rate of refrigerant from the liquid separating device to the secondary inlet of the ejector is increased.

The pressure prevailing inside the receiver could, e.g., be decreased by increasing a compressor capacity allocated for compressing refrigerant received from the gaseous outlet of the receiver.

Alternatively or additionally, the step of increasing the flow rate of refrigerant from the liquid separating device to the secondary inlet of the ejector may comprise increasing a pressure of refrigerant leaving the heat rejecting heat exchanger and entering a primary inlet of the ejector. Increasing the pressure of refrigerant leaving the heat rejecting heat exchanger will also increase the pressure difference across the ejector, resulting in an increase in the flow of refrigerant from the liquid separating device to the secondary inlet of the ejector, as described above.

The pressure of refrigerant leaving the heat rejecting heat exchanger could, e.g., be increased by decreasing an opening degree of the primary inlet of the ejector. Alternatively or additionally, the pressure of refrigerant leaving the heat rejecting heat exchanger could be increased by decreasing a secondary fluid flow across the heat rejecting heat exchanger, e.g. by reducing a speed of a fan driving a secondary air flow across the heat rejecting heat exchanger or by adjusting a pump driving a secondary liquid flow across the heat rejecting heat exchanger.

The step of reducing the flow rate of liquid refrigerant from the evaporator(s) to the liquid separating device may comprise preventing at least some of the evaporator(s) from being operated in a flooded state. When at least some of the evaporator(s) which were previously allowed to be operated in a flooded state are prevented from doing so, it must be expected that the total amount of liquid refrigerant being supplied to the suction line, and thereby to the liquid separating device, from the evaporator(s) is reduced. For instance, all of the evaporators may be prevented from being operated in a flooded state. In this case, liquid refrigerant is no longer allowed to pass through any of the evaporators, i.e. no liquid refrigerant enters the suction line and thereby the liquid separating device, and the amount of liquid refrigerant in the liquid separating device is not increased, regardless of the flow rate of refrigerant from the liquid separating device to the secondary inlet of the ejector.

The evaporator(s) may, e.g., be prevented from operating in a flooded state by increasing a setpoint value or a lower limit for the superheat of refrigerant leaving the evaporator(s), and subsequently controlling the refrigerant supply to the evaporator(s) in accordance with the increased setpoint value or lower limit.

The superheat of refrigerant leaving an evaporator is the temperature difference between the temperature of refrigerant leaving the evaporator and the dew point of the refrigerant leaving the evaporator. Thus, a high superheat value indicates that all of the liquid refrigerant supplied to the evaporator is evaporated well before it reaches the outlet of the evaporator. As described above, this results in a relatively poor heat transfer in the evaporator. However, only gaseous refrigerant passes through the evaporator. Similarly, zero superheat indicates that liquid refrigerant is present along the entire length of the evaporator, i.e. that the evaporator is operated in a flooded state. Thus, selecting a positive setpoint for the superheat value will prevent the evaporator from being operated in a flooded state.

As an alternative, the evaporator(s) may be prevented from being operated in a flooded state by reducing a maximum allowable opening degree of the expansion device(s). This will limit the refrigerant supply to the evaporator(s), thereby reducing the amount of liquid refrigerant passing through the evaporator(s), entering the suction line and being supplied to the liquid separating device.

Alternatively or additionally, the step of reducing the flow rate of liquid refrigerant from the evaporator(s) to the liquid separating device may comprise decreasing a pressure prevailing in the suction line of the vapour compression system. When the pressure prevailing in the suction line is decreased, the pressure of the refrigerant passing through the evaporator(s) is also decreased. Thereby the dew point of the refrigerant is also decreased, causing a larger portion of the refrigerant to evaporate while passing through the evaporator(s). Accordingly, the amount of liquid refrigerant passing through the evaporator(s) is decreased.

The step of detecting the flow rate of refrigerant from the liquid separating device to the secondary inlet of the ejector may comprise measuring the flow rate by means of a flow switch and/or a flow sensor. The flow switch and/or flow sensor may advantageously be arranged in the part of the refrigerant path which interconnects the liquid separating device and the secondary inlet of the ejector.

The step of determining whether or not the flow rate of refrigerant from the liquid separating device to the secondary inlet of the ejector is sufficient to remove liquid refrigerant produced by the evaporator(s) being allowed to be operated in a flooded state from the liquid separating device may comprise measuring a temperature of refrigerant in the suction line. This could, e.g., include monitor the suction temperature for the compressors in order to establish whether or not it is or approaches saturation (i.e. the dew-point). If this is the case, the flow rate of refrigerant from the liquid separating device to the secondary inlet of the ejector is most likely not sufficient to remove liquid refrigerant produced by the evaporator(s) being allowed to be operated in a flooded state.

As an alternative, temperature variations may be monitored and analysed. When analysing the temperature measurement behaviour (signal analysis), it is possible to determine if liquid is present in the suction line.

As an alternative, in the case that a suction line heat exchanger is arranged in the suction line, in order to cause at least a part of the liquid refrigerant entering the suction line to evaporate, one or more temperatures being suitable for establishing a heat balance of the suction line heat exchanger may be measured.

The suction line heat exchanger may arranged between the gaseous outlet of the liquid separating device and the inlet of the compressor, and it may be arranged to provide heat exchange between refrigerant flowing in this part of the refrigerant path and a secondary flow of a hotter fluid medium, e.g. refrigerant leaving the heat rejecting heat exchanger. Accordingly, the refrigerant flowing from the liquid separating device towards the compressor unit is heated when passing through the suction line heat exchanger. The massflows through such a suction line heat exchanger can be derived from the current compressor capacity.

The secondary massflow is cooled according to the measured temperatures and the following equation:

$$Q=m_{sec}\cdot C_{p,sec}\cdot(t_a-t_b),$$

where $C_{p,sec}$ is the heat capacity of the secondary flow, $t_a$ is the inlet temperature of the secondary flow and $t_b$ is the outlet temperature of the secondary flow.

Similarly, the primary temperature, $t_B$, can be predicted using the following equation:

$$Q=m_{pri}\cdot C_{p,pri}\cdot(t_A-t_B),$$

where $C_{p,pri}$ is the heat capacity of the primary flow, $t_A$ is the inlet temperature of the primary flow and $t_B$ is the outlet temperature of the primary flow.

If the predicted temperature is higher than the actual measured temperature, it means that some of the energy transferred from the secondary side is used to evaporate liquid, and it is possible to calculate how much.

The step of determining whether or not the flow rate of refrigerant from the liquid separating device to the secondary inlet of the ejector is sufficient to remove liquid refrigerant produced by the evaporator(s) being allowed to be operated in a flooded state from the liquid separating device may be performed on the basis of characteristics of the ejector. For instance, a very simple model could be used, in which the temperature of refrigerant leaving the heat rejecting heat exchanger is monitored. In the case that the temperature decreases below a certain threshold value, this is an indication that the ejector is no longer operating.

BRIEF DESCRIPTION OF THE DRAWINGS

The invention will now be described with reference to the accompanying drawings in which.

DETAILED DESCRIPTION

Figure 1:
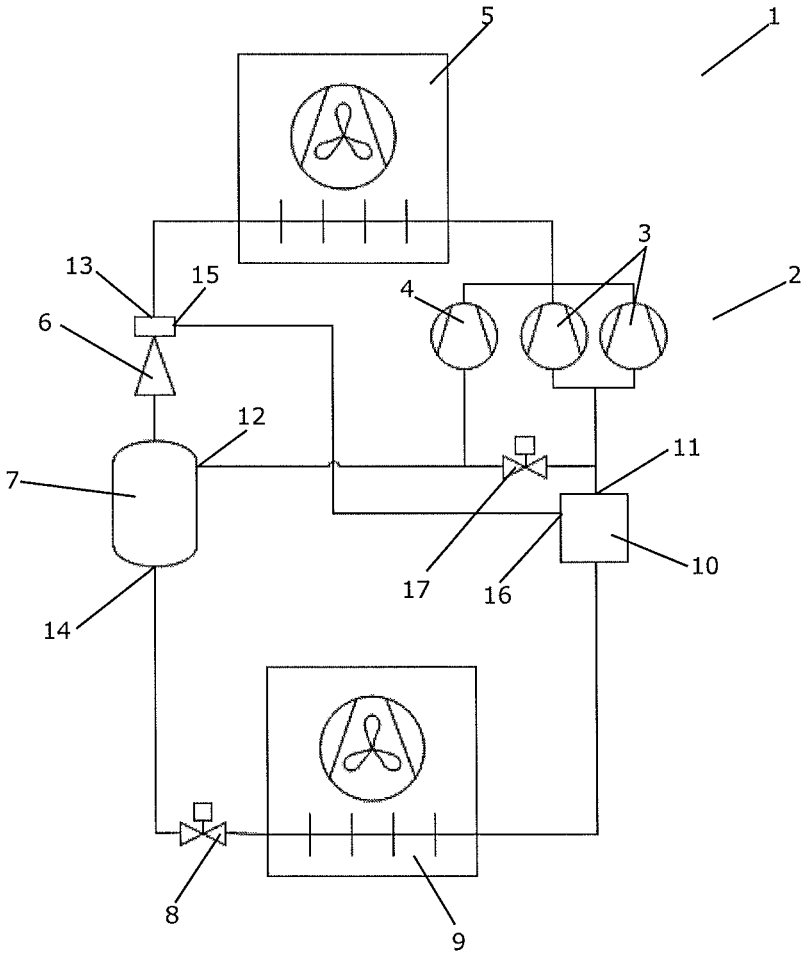
FIG. 1 is a diagrammatic view of a vapour compression system being controlled in accordance with a method according to a first embodiment of the invention.

FIG. 1 is a diagrammatic view of a vapour compression system 1 being controlled in accordance with a method according to a first embodiment of the invention. The vapour compression system 1 comprises a compressor unit 2 comprising a number of compressors 3, 4, three of which are shown, a heat rejecting heat exchanger 5, an ejector 6, a receiver 7, an expansion device 8, in the form of an expansion valve, an evaporator 9, and a liquid separating device 10, arranged in a refrigerant path.

Two of the shown compressors 3 are connected to a gaseous outlet 11 of the liquid separating device 10. Accordingly, gaseous refrigerant leaving the evaporator 9 can be supplied to these compressors 3, via the liquid separating device 10. The third compressor 4 is connected to a gaseous outlet 12 of the receiver 7. Accordingly, gaseous refrigerant can be supplied directly from the receiver 7 to this compressor 4.

Refrigerant flowing in the refrigerant path is compressed by the compressors 3, 4 of the compressor unit 2. The compressed refrigerant is supplied to the heat rejecting heat exchanger 5, where heat exchange takes place in such a manner that heat is rejected from the refrigerant.

The refrigerant leaving the heat rejecting heat exchanger 5 is supplied to a primary inlet 13 of the ejector 6, before being supplied to the receiver 7. When passing through the ejector 6 the refrigerant undergoes expansion. Thereby the pressure of the refrigerant is reduced, and the refrigerant being supplied to the receiver 7 is in a mixed liquid and gaseous state.

In the receiver 7 the refrigerant is separated into a liquid part and a gaseous part. The liquid part of the refrigerant is supplied to the evaporator 9, via a liquid outlet 14 of the receiver 7 and the expansion device 8. In the evaporator 9, the liquid part of the refrigerant is at least partly evaporated, while heat exchange takes place in such a manner that heat is absorbed by the refrigerant.

The evaporator 9 is allowed to be operated in a flooded state, i.e. in such a manner that liquid refrigerant is present along the entire length of the evaporator 9. Thereby some of the refrigerant passing through the evaporator 9 and entering the suction line may be in a liquid state.

The refrigerant leaving the evaporator 9 is received in the liquid separating device 10, where the refrigerant is separated into a liquid part and a gaseous part. The liquid part of the refrigerant is supplied to a secondary inlet 15 of the ejector 6, via a liquid outlet 16 of the liquid separating device 10. At least some of the gaseous refrigerant may be supplied to the compressors 3 of the compressor unit 2 via the gaseous outlet 11 of the liquid separating device 10. However, it is not ruled out that at least some of the gaseous refrigerant is supplied to the secondary inlet 15 of the ejector 6, via the liquid outlet 16 of the liquid separating device 10.

Accordingly, the liquid separating device 10 ensures that any liquid refrigerant which passes through the evaporator 9 is prevented from reaching the compressors 3, 4 of the compressor unit 2. Instead such liquid refrigerant is supplied to the secondary inlet 15 of the ejector 6.

The gaseous part of the refrigerant in the receiver 7 may be supplied to the compressor 4. Furthermore, some of the gaseous refrigerant in the receiver 7 may be supplied to compressors 3, via a bypass valve 17. Opening the bypass valve 17 increases the compressor capacity being available for compressing refrigerant received from the gaseous outlet 12 of the receiver 7.

According to the method of the invention, a flow rate of refrigerant from the liquid separating device 10 to the secondary inlet 15 of the ejector 6 is detected. It is further determined whether or not the flow rate is sufficient to remove the liquid refrigerant which is allowed to pass through the evaporator 9 and enter the liquid separating device 10.

If the flow rate is insufficient to remove the liquid refrigerant produced by the evaporator 9, then liquid refrigerant will accumulate in the liquid separating device 10, eventually resulting in liquid refrigerant flowing towards the compressor unit 2, via the gaseous outlet 11 of the liquid separating device 10. This is undesirable, since it may cause damage to the compressors 3, 4.

Therefore, when it is determined that the flow rate is insufficient to remove the liquid refrigerant produced by the evaporator 9, the flow rate of refrigerant from the liquid separating device 10 to the secondary inlet 15 of the ejector 6 is increased, and/or a flow rate of liquid refrigerant from the evaporator 9 to the liquid separating device 10 is decreased. Thereby it is ensured that the flow rate of refrigerant from the liquid separating device 10 to the secondary inlet 15 of the ejector 6 is sufficient to remove the liquid refrigerant produced by the evaporator 9, and accumulation of liquid refrigerant in the liquid separating device 10 is avoided.

The flow rate of refrigerant from the liquid separating device 10 to the secondary inlet 15 of the ejector 6 could, e.g., be increased by decreasing a pressure prevailing inside the receiver 7 and/or by increasing a pressure of refrigerant leaving the heat rejecting heat exchanger 5 and entering the primary inlet 13 of the ejector 6. This has been described in detail above.

The flow rate of liquid refrigerant from the evaporator 9 to the liquid separating device 10 could, e.g., be decreased by preventing the evaporator 9 from operating in a flooded state or by decreasing a pressure prevailing in the suction line. This has been described in detail above.

Figure 2:
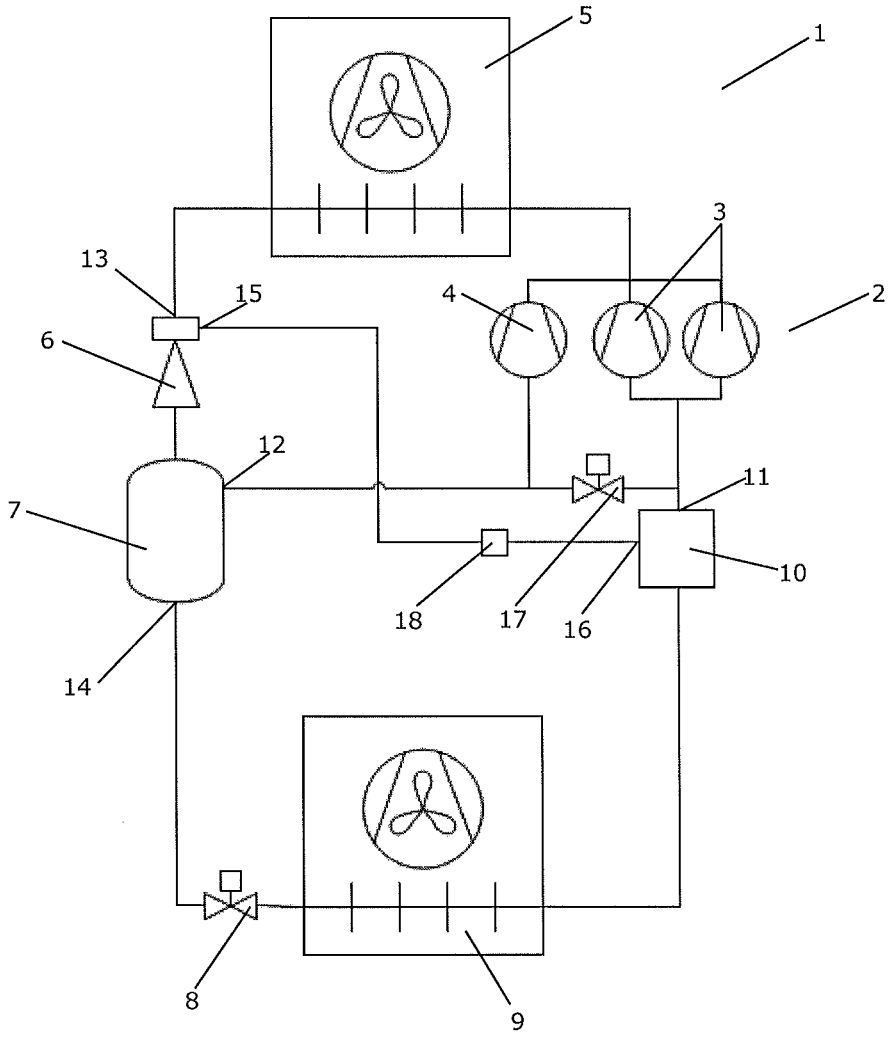
FIG. 2 is a diagrammatic view of a vapour compression system being controlled in accordance with a method according to a second embodiment of the invention.

FIG. 2 is a diagrammatic view of a vapour compression system 1 being controlled in accordance with a method according to a second embodiment of the invention. The vapour compression system 1 of FIG. 2 is very similar to the vapour compression system 1 of FIG. 1, and it will therefore not be described in detail here.

In the vapour compression system 1 of FIG. 2, a flow sensor 18 is arranged in the part of the refrigerant path which interconnects the liquid outlet 16 of the liquid separating device 10 and the secondary inlet 15 of the ejector 6. The flow sensor 18 is used for detecting the flow rate of refrigerant from the liquid separating device 10 to the secondary inlet 15 of the ejector 6. Furthermore, a flow switch could be arranged in this part of the refrigerant path, or the flow sensor 18 could be replaced by a flow switch.

Figure 3:
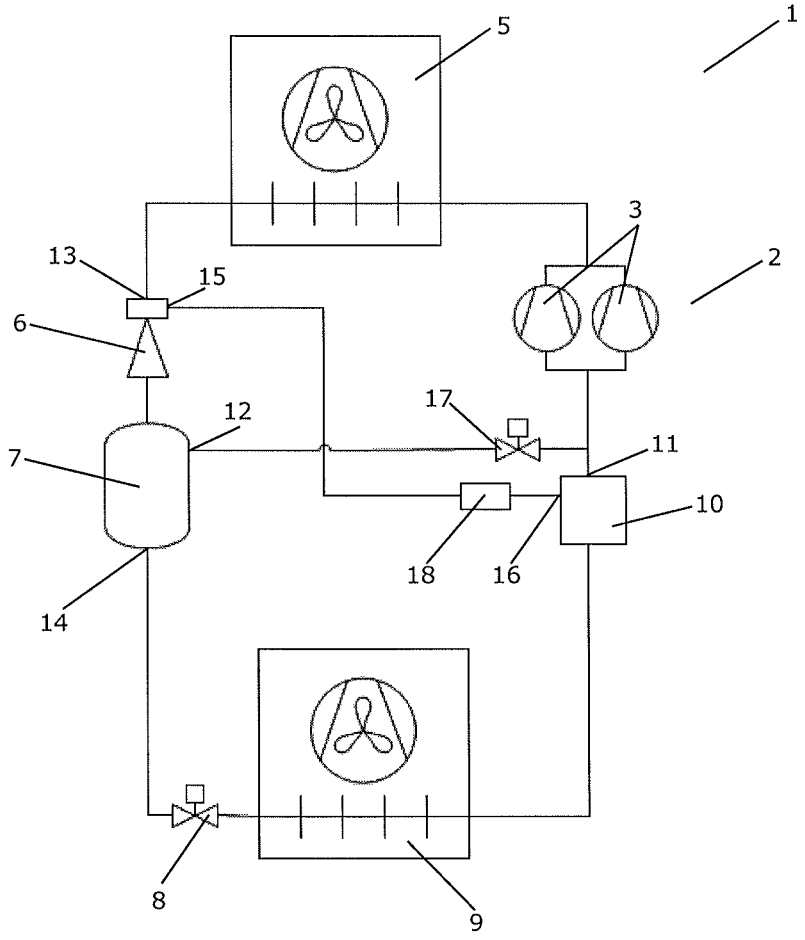
FIG. 3 is a diagrammatic view of a vapour compression system being controlled in accordance with a method according to a third embodiment of the invention.

FIG. 3 is a diagrammatic view of a vapour compression system 1 being controlled in accordance with a method according to a third embodiment of the invention. The vapour compression system 1 of FIG. 3 is very similar to the vapour compression systems 1 of FIGS. 1 and 2, and it will therefore not be described in detail here.

In the vapour compression system 1 of FIG. 3, only two compressors 3 are shown in the compressor unit 2. Both of the compressors 3 are connected to the gaseous outlet 11 of the liquid separating device 10. Accordingly, gaseous refrigerant from the receiver 7 can only be supplied to the compressor unit 2 via the bypass valve 17.

Figure 4:
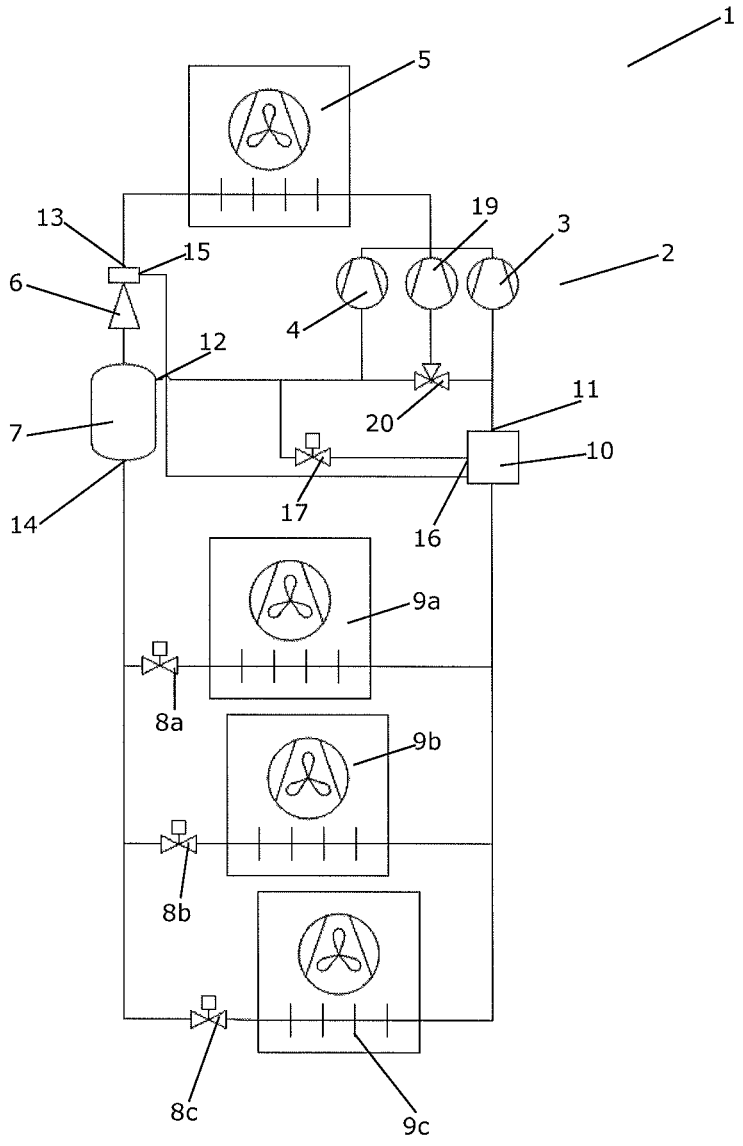
FIG. 4 is a diagrammatic view of a vapour compression system being controlled in accordance with a method according to a fourth embodiment of the invention.

FIG. 4 is a diagrammatic view of a vapour compression system 1 being controlled in accordance with a method according to a fourth embodiment of the invention. The vapour compression system 1 of FIG. 4 is very similar to the vapour compression systems 1 of FIGS. 1-3, and it will therefore not be described in detail here.

In the compressor unit 2 of the vapour compression system 1 of FIG. 4, one compressor 3 is shown as being connected to the gaseous outlet 11 of the liquid separating device 10 and one compressor 4 is shown as being connected to the gaseous outlet 12 of the receiver 7. A third compressor 19 is shown as being provided with a three way valve 20 which allows the compressor 19 to be selectively connected to the gaseous outlet 11 of the liquid separating device 10 or to the gaseous outlet 12 of the receiver 7. Thereby some of the compressor capacity of the compressor unit 2 can be shifted between 'main compressor capacity', i.e. when the compressor 19 is connected to the gaseous outlet 11 of the liquid separating device 10, and 'receiver compressor capacity', i.e. when the compressor 19 is connected to the gaseous outlet 12 of the receiver 7. Thereby it is possible to adjust the pressure prevailing inside the receiver 7, and thereby the flow rate of refrigerant from the liquid separating device 10 to the secondary inlet 15 of the ejector 6, by operating the three way valve 20, thereby increasing or decreasing the amount of compressor capacity being available for compressing refrigerant received from the gaseous outlet 12 of the receiver 7.

Furthermore, the vapour compression system 1 of FIG. 4 comprises three expansion devices 8*a*, 8*b*, 8*c* and three evaporators 9*a*, 9*b*, 9*c*, arranged fluidly in parallel in the refrigerant path. Each of the expansion devices 8*a*, 8*b*, 8*c* is arranged to control a flow of refrigerant to one of the evaporators 9*a*, 9*b*, 9*c*.

When controlling the vapour compression system 1 of FIG. 4, all of the evaporators 9*a*, 9*b*, 9*c* may be allowed to be operated in a flooded state, or only some of the evaporators 9*a*, 9*b*, 9*c* may be allowed to be operated in a flooded state.

While the present disclosure has been illustrated and described with respect to a particular embodiment thereof, it should be appreciated by those of ordinary skill in the art that various modifications to this disclosure may be made without departing from the spirit and scope of the present disclosure.

What is claimed is:

1. A method for controlling a vapour compression system, the vapour compression system comprising a compressor unit, a heat rejecting heat exchanger, an ejector, a receiver, at least one expansion device and at least one evaporator arranged in a refrigerant path, the vapour compression system further comprising a liquid separating device arranged in a suction line of the of vapour compression system, the liquid separating device comprising a gaseous outlet connected to the inlet of the compressor unit and a liquid outlet connected to a secondary inlet of the ejector, the method comprising the steps of:

allowing at least one evaporator to be operated in a flooded state, detecting a flow rate of refrigerant from the liquid separating device to the secondary inlet of the ejector, and determining whether or not the flow rate is sufficient to remove liquid refrigerant produced by the evaporator(s) being allowed to be operated in a flooded state from the liquid separating device, and in the case that it is determined that the flow rate of refrigerant from the liquid separating device to the secondary inlet of the ejector is insufficient to remove liquid refrigerant produced by the evaporator(s) being allowed to be operated in a flooded state from the liquid separating device, increasing the flow rate of refrigerant from the liquid separating device to the secondary inlet of the ejector, and/or decreasing a flow rate of liquid refrigerant from the evaporator(s) to the liquid separating device.

2. The method according to claim 1, wherein the step of increasing the flow rate of refrigerant from the liquid separating device to the secondary inlet of the ejector comprises reducing a pressure prevailing inside the receiver.

3. The method according to claim 2, wherein the step of increasing the flow rate of refrigerant from the liquid separating device to the secondary inlet of the ejector comprises increasing a pressure of refrigerant leaving the heat rejecting heat exchanger and entering a primary inlet of the ejector.

4. The method according to claim 2, wherein the step of reducing the flow rate of liquid refrigerant from the evaporator(s) to the liquid separating device comprises preventing at least some of the evaporator(s) from being operated in a flooded state.

5. The method according to claim 2, wherein the step of reducing the flow rate of liquid refrigerant from the evaporator(s) to the liquid separating device comprises decreasing a pressure prevailing in the suction line of the vapour compression system.

6. The method according to claim 2, wherein the step of detecting the flow rate of refrigerant from the liquid separating device to the secondary inlet of the ejector comprises measuring the flow rate by means of a flow switch and/or a flow sensor.

7. The method according to claim 2, wherein the step of determining whether or not the flow rate of refrigerant from the liquid separating device to the secondary inlet of the ejector is sufficient to remove liquid refrigerant produced by the evaporator(s) being allowed to be operated in a flooded state from the liquid separating device comprises measuring a temperature of refrigerant in the suction line.

8. The method according to claim 1, wherein the step of increasing the flow rate of refrigerant from the liquid separating device to the secondary inlet of the ejector comprises increasing a pressure of refrigerant leaving the heat rejecting heat exchanger and entering a primary inlet of the ejector.

9. The method according to claim 8, wherein the step of reducing the flow rate of liquid refrigerant from the evaporator(s) to the liquid separating device comprises preventing at least some of the evaporator(s) from being operated in a flooded state.

10. The method according to claim 8, wherein the step of reducing the flow rate of liquid refrigerant from the evaporator(s) to the liquid separating device comprises decreasing a pressure prevailing in the suction line of the vapour compression system.

11. The method according to claim 8, wherein the step of detecting the flow rate of refrigerant from the liquid separating device to the secondary inlet of the ejector comprises measuring the flow rate by means of a flow switch and/or a flow sensor.

12. The method according to claim 8, wherein the step of determining whether or not the flow rate of refrigerant from the liquid separating device to the secondary inlet of the ejector is sufficient to remove liquid refrigerant produced by the evaporator(s) being allowed to be operated in a flooded state from the liquid separating device comprises measuring a temperature of refrigerant in the suction line.

13. The method according to claim 1, wherein the step of reducing the flow rate of liquid refrigerant from the evaporator(s) to the liquid separating device comprises preventing at least some of the evaporator(s) from being operated in a flooded state.

14. The method according to claim 13, wherein the step of reducing the flow rate of liquid refrigerant from the evaporator(s) to the liquid separating device comprises decreasing a pressure prevailing in the suction line of the vapour compression system.

15. The method according to claim 13, wherein the step of detecting the flow rate of refrigerant from the liquid separating device to the secondary inlet of the ejector comprises measuring the flow rate by means of a flow switch and/or a flow sensor.

16. The method according to claim 1, wherein the step of reducing the flow rate of liquid refrigerant from the evaporator(s) to the liquid separating device comprises decreasing a pressure prevailing in the suction line of the vapour compression system.

17. The method according to claim 16, wherein the step of detecting the flow rate of refrigerant from the liquid separating device to the secondary inlet of the ejector comprises measuring the flow rate by means of a flow switch and/or a flow sensor.

18. The method according to claim 1, wherein the step of detecting the flow rate of refrigerant from the liquid separating device to the secondary inlet of the ejector comprises measuring the flow rate by means of a flow switch and/or a flow sensor.

19. The method according to claim 1, wherein the step of determining whether or not the flow rate of refrigerant from the liquid separating device to the secondary inlet of the ejector is sufficient to remove liquid refrigerant produced by the evaporator(s) being allowed to be operated in a flooded state from the liquid separating device comprises measuring a temperature of refrigerant in the suction line.

20. The method according to claim 1, wherein the step of determining whether or not the flow rate of refrigerant from the liquid separating device to the secondary inlet of the ejector is sufficient to remove liquid refrigerant produced by the evaporator(s) being allowed to be operated in a flooded state from the liquid separating device is performed on the basis of characteristics of the ejector.

* * * * *